United States Patent [19]

Malagari, Jr.

[11] 4,078,952

[45] Mar. 14, 1978

[54] CONTROLLING THE MANGANESE TO SULFUR RATIO DURING THE PROCESSING FOR HIGH PERMEABILITY SILICON STEEL

[75] Inventor: Frank A. Malagari, Jr., Freeport, Pa.

[73] Assignee: Allegheny Ludlum Industries, Inc., Pittsburgh, Pa.

[21] Appl. No.: 696,969

[22] Filed: Jun. 17, 1976

[51] Int. Cl.[2] ..... H01F 1/04

[52] U.S. Cl. ..... 148/111; 148/31.55; 148/112; 75/123 L

[58] Field of Search ..... 148/110, 111, 112, 113, 148/31.55; 75/123 L

[56] References Cited

U.S. PATENT DOCUMENTS

| | | | |
|---|---|---|---|
| 3,855,018 | 12/1974 | Salsgiver et al. | 148/112 |
| 3,855,019 | 12/1974 | Salsgiver et al. | 148/112 |
| 3,930,906 | 1/1976 | Irie et al. | 148/113 |
| 3,957,546 | 5/1976 | Fiedler | 148/111 |

*Primary Examiner*—Walter R. Satterfield

*Attorney, Agent, or Firm*—Vincent G. Gioia; Robert F. Dropkin

[57] ABSTRACT

A process for producing electromagnetic silicon steel having a cube-on-edge orientation and a permeability of at least 1870 ($G/O_e$) at 10 oersteds. Involved therein are the steps of cold rolling a hot rolled band to final gage without an intermediate anneal between cold rolling passes; and preparing said band from a melt having 0.0006 to 0.0018% boron, and manganese and sulfur contents which produce a manganese to sulfur ratio of at least 1.83 in said band.

14 Claims, No Drawings

CONTROLLING THE MANGANESE TO SULFUR RATIO DURING THE PROCESSING FOR HIGH PERMEABILITY SILICON STEEL

The present invention relates to an improvement in the manufacture of grain-oriented silicon steel.

U.S. Pat. No. 3,957,546 describes a process for producing high permeability silicon steel having a cube-on-edge orientation. Basically, said patent attributes the attainment of high permeability to the presence of small critical amounts of boron and controlled manganese to sulfur ratios. Specifically, said patent calls for a maximum manganese to sulfur ratio of 1.8. Through this invention, there is now provided a process for making high permeability silicon steel, that is, silicon steel with a permeability of at least 1870, and preferably at least 1900 ($G/O_e$) at 10 oersteds, without maintaining a manganese to sulfur ratio on the order of that specified in said patent. By controlling boron contents within a range of from 0.0006 to 0.0018%, and by preferably having at least 0.0008% boron, high permeability silicon steels are now produced with manganese to sulfur ratios in excess of 1.83, and even 2.1; and although it is not known for sure, there is some belief that an improvement in processing and/or surface quality can be attributed to the higher ratios. Moreover, it has been shown that steel coils with low ratios usually have at least one poor end when the coils are cold rolled without an intermediate anneal between cold rolling passes.

As inferred in the last sentence of the preceding paragraph, the present invention pertains to a process in which coils are cold rolled without an intermediate anneal between cold rolling passes. Consequently, the invention is clearly distinguishable from U.S. Pat. No. 3,905,843 which requires two distinct cold reductions with an intermediate anneal therebetween. Said invention is also distinguishable from other patents describing boron-bearing melts; namely, U.S. Pat. Nos. 3,873,381, 3,905,842 and 3,929,522. U.S. Pat. No. 3,873,381 discloses minimum boron levels in excess of the maximum for the present invention, and U.S. Pat. No. 3,905,842 relates to steels wherein at least 0.007% sulfur is present in solute form during final texture annealing. U.S. Pat. No. 3,929,522 relates to an aluminum-nitride inhibited steel.

It is accordingly an object of the present invention to provide an improvement in the manufacture of grain-oriented silicon steels.

In accordance with the present invention, a melt of silicon steel having from 0.0006 to 0.0018% boron, and manganese and sulfur contents which will result in the formation of a hot rolled band having a manganese to sulfur ratio of at least 1.83, is prepared and processed into electromagnetic silicon steel having a permeability of at least 1870, and preferably 1900 ($G/O_e$) at 10 oersteds. Processing involves only a single cold reduction, that is a rolling procedure wherein there are no intermediate anneals between cold rolling passes. Specifically, a melt of silicon steel containing, by weight, 0.02 to 0.06% carbon, 0.015 to 0.15% manganese, 0.01 to 0.05% sulfur, 0.0006 to 0.0018% boron, up to 0.0100% nitrogen, 2.5 to 4.0% silicon, up to 1.0% copper and no more than 0.008% aluminum, is subjected to the conventional steps of casting, hot rolling to a band having a thickness of from about 0.050 to about 0.120 inch, cold rolling to a thickness no greater than 0.020 inch without an intermediate anneal between cold rolling passes, decarburizing and final texture annealing. Specific processing as to the conventional steps can be in accordance with that specified in the patents cited hereinabove. Moreover, the term casting is intended to include continuous casting processes. A hot rolled band heat treatment is also includable within the scope of the present invention. Melts containing at least 0.008% boron are preferred, as are copper contents between 0.3 and 1.0%. Copending U.S. Pat. application Ser. No. 696,970 filed concurrently herewith, addresses itself to the benefits of copper contents between 0.3 and 1.0% and between 0.5 and 1.0%.

In view of the high manganese to sulfur ratio of the present invention, less than 0.006% sulfur in solute form is present at the start of the final texture anneal. As noted hereinabove, it is undesirable to have a low manganese to sulfur ratio as coils produced from heats with low ratios usually have at least one poor end when the coils are cold rolled without an intermediate anneal between cold rolling passes. Coils produced in accordance with the present invention preferably have a core loss of no more than 0.700 watts per pound at 17 kilogauss and a permeability of at least 1870 ($G/O_e$) at 10 oersteds, at both ends. It is also within the context of the subject invention to replace part or all of the sulfur with selenium. Manganese to sulfur and/or manganese to sulfur plus selenium ratios, often exceed 2.1. Ratios of at least 1.83 are, however, maintained through the processing described hereinabove.

The following examples are illustrative of several aspects of the invention.

EXAMPLE I

Three heats (Heats A, B and C) were melted and processed into coils of silicon steel having a cube-on-edge orientation. The chemistry of the heats appears hereinbelow in Table I.

TABLE I

| | Composition (wt. %) | | | | | | | | |
|---|---|---|---|---|---|---|---|---|---|
| heat | C | Mn | S | B | N | Si | Cu | Al | Fe |
| A | 0.025 | 0.035 | 0.015 | 0.0011 | 0.0047 | 3.13 | 0.35 | 0.006 | Bal. |
| B | 0.030 | 0.035 | 0.020 | 0.0009 | 0.0044 | 3.22 | 0.36 | 0.004 | Bal. |
| C | 0.029 | 0.035 | 0.019 | :0.0016 | 0.0036 | 3.17 | 0.36 | 0.006 | Bal. |

Processing for the heats involved soaking at an elevated temperature for several hours, hot rolling to a nominal gage of 0.080 inch, coil preparation, hot roll band normalizing at a temperature of approximately 1740° F, cold rolling to final gage, decarburizing at a temperature of approximately 1475° F, and final texture annealing at a maximum temperature of 2150° F in hydrogen.

A coil from each heat was measured for gage and tested for permeability and core loss. The results of the tests appear hereinbelow in Table II, along with the manganese to sulfur ratios of each end of the hot rolled band.

TABLE II

| Heat | Hot rolled Band Mn/S | Coil No. | Gage (Mils) | Cored Loss (WPP at 17 KB) | Permeability (at 10 $O_e$) |
|---|---|---|---|---|---|
| A | 1.95 | 4 In | 11.2 | 0.660 | 1939 |

TABLE II-continued

| Heat | Hot rolled Band Mn/S | Coil No. | Gage (Mils) | Cored Loss (WPP at 17 KB) | Permeability (at 10 $O_e$) |
|---|---|---|---|---|---|
| | 2.47 | Out | 10.4 | 0.695 | 1910 |
| B | 2.22 | 7 In | 11.3 | 0.660 | 1921 |
| | 2.29 | Out | 11.0 | 0.651 | 1929 |
| C | 1.90 | 8 In | 11.8 | 0.699 | 1918 |
| | 2.10 | Out | 10.6 | 0.660 | 1908 |

From Table II it is clear that a steel having from 0.0006 to 0.0018% boron, and manganese and sulfur contents which will result in the formation of a hot rolled band having a manganese to sulfur ratio of at least 1.83, can be processed with a single cold reduction into a coil of electromagnetic silicon steel having a permeability of at least 1870 and a core loss of no more than 0.700 watts per pound at 17 kilogauss. Significantly, all three coils had a permeability in excess of 1900 ($G/O_e$) at 10 oersteds. Coil 7 from Heat B had a manganese to sulfur ratio in excess of 2.1 at both ends.

EXAMPLE II

Another heat (Heat D) having the chemistry set forth in Table III, hereinbelow, was processed as were Heats A, B and C.

TABLE III

| Heat | Composition (wt. %) | | | | | | | | |
|---|---|---|---|---|---|---|---|---|---|
| | C | Mn | S | B | N | Si | Cu | Al | Fe |
| D | 0.030 | 0.024 | 0.023 | 0.0014 | 0.0066 | 3.16 | 0.26 | 0.004 | Bal. |

A coil from said heat was measured for gage and tested for permeability and core loss. The results of the tests appear hereinbelow in Table IV, along with the manganese to sulfur ratios of each end of the hot rolled band.

TABLE IV

| Heat | Hot Rolled Band Mn/S | Coil No. | Gage (Mils) | Core Loss (WPP at 17 KB) | Permeability (at 10 Oe) |
|---|---|---|---|---|---|
| D | 1.04 | 6 In | 10.5 | 0.692 | 1846 |
| | 1.13 | Out | 10.9 | 1.41 | 1468 |

Table IV indicates a wide difference in the magnetic properties of each end of coil 6, Heat D. Significantly, Head D had rather low manganese to sulfur ratios of 1.04 and 1.13, at each end; and as noted hereinabove, coils with low ratios usually have at least one poor end when the coils are cold rolled without an intermediate anneal between cold rolling passes. The present invention unlike Heat D, calls for a hot rolled band with a minimum manganese to sulfur ratio of 1.83.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A process for producing electromagnetic silicon steel having a cube-on-edge orientation and a permeability of at least 1870 ($G/O_e$) at 10 oersteds, which comprises the steps of: preparing a melt of silicon steel consisting essentially of, by weight, 0.02 to 0.06% carbon, 0.015 to 0.15% manganese, 0.01 to 0.05% sulfur, 0.0006 to 0.0018% boron, up to 0.0100% nitrogen, 2.5 to 4.0% silicon, up to 1.0% copper, no more than 0.008% aluminum, balance iron, said manganese and sulfur being such so as to result in the formation of a hot rolled band having a manganese to sulfur ratio of at least 1.83; casting said steel; hot rolling said steel to a band having a thickness of from about 0.050 to about 0.120 inch and a manganese to sulfur ratio of at least 1.83; cold rolling said steel from said thickness to a final gage no greater than 0.020 inch without an intermediate anneal between cold rolling passes; decarburizing said steel; and final texture annealing said steel, said steel having less than 0.006% sulfur in solute form at the start of said annealing; said manganese to sulfur ratio being maintained at a level of at least 1.83 through said processing; said texture annealed steel having a permeability of at least 1870 ($G/O_e$) at 10 oersteds.

2. A process according to claim 1, wherein said melt has at least 0.0008% boron.

3. A process according to claim 2, wherein said melt has between 0.3 and 1.0% copper.

4. A process according to claim 3, wherein said melt has in excess of 0.5% copper.

5. A process according to claim 2, wherein the oriented silicon steel has a permeability of at least 1900 ($G/O_e$) at 10 oersteds.

6. A process according to claim 2, wherein the oriented silicon steel has a core loss of no more than 0.700 watts per pound at 17 kilogauss.

7. A process according to claim 2, including the step of preparing a coil from said steel, and wherein each end of said coil has a permeability of at least 1870 ($G/O_e$) at 10 oersteds and a core loss of no more than 0.700 watts per pound at 17 kilogauss.

8. A process according to claim 1, wherein said hot rolled band has a manganese to sulfur ratio in excess of 2.1.

9. A process for producing electromagnetic silicon steel having a cube-on-edge orientation and a permeability of at least 1870 ($G/O_e$) at 10 oersteds, which comprises the steps of: preparing a melt of silicon steel consisting essentially of by weight, 0.02 to 0.06% carbon, 0.015 to 0.15% manganese, 0.01 to 0.05% of material from the group consisting of sulfur and selenium, 0.0006 to 0.0018% boron, up to 0.0100% nitrogen, 2.5 to 4.0% silicon, up to 1.0% copper, no more than 0.008% aluminum, balance iron, said manganese and sulfur and/or selenium being such so as to result in the formation of a hot rolled band having a manganese to sulfur plus selenium ratio of at least 1.83; casting said steel; hot rolling said steel to a band having a thickness of from about 0.050 to about 0.120 inch and a manganese to sulfur plus selenium ratio of at least 1.83; cold rolling said steel from said thickness to a final gage no greater than 0.020 inch without an intermediate anneal between cold rolling passes; decarburizing said steel; and final texture annealing said steel, said steel having less than 0.006% sulfur in a solute form at the start of said annealing; said manganese to sulfur plus selenium ratio being maintained at a lever of at least 1.83 through said processing; said texture annealed steel having a permeability of at least 1870 ($G/O_e$) at 10 oersteds.

10. A process according to claim 9, wherein said melt has at least 0.0008% boron.

11. A process according to claim 9, wherein said melt has between 0.3 and 1.0% copper.

12. A process according to claim 9, wherein said hot rolled band has a manganese to sulfur plus selenium ratio in excess of 2.1.

13. A cube-on-edge oriented silicon steel having a permeability of at least 1870 ($G/O_e$) at 10 oersteds, and made in accordance with the process of claim 2.

14. A cube-on-edge oriented silicon steel having a permeability of at least 1870 ($G/O_e$) at 10 oersteds, and made in accordance with the process of claim 10.

* * * * *